US006451145B1

(12) United States Patent
Forbes

(10) Patent No.: US 6,451,145 B1
(45) Date of Patent: Sep. 17, 2002

(54) WEB SPLICING SYSTEM

(75) Inventor: Thomas J. Forbes, Towanda, PA (US)

(73) Assignee: Frontier Industrial Technology, Inc., Towanda, PA (US)

( * ) Notice: Subject to any disclaimer, the term of this patent is extended or adjusted under 35 U.S.C. 154(b) by 0 days.

(21) Appl. No.: 09/561,638

(22) Filed: May 2, 2000

Related U.S. Application Data

(63) Continuation-in-part of application No. 09/036,958, filed on Mar. 9, 1998, now abandoned.

(51) Int. Cl.[7] ..... B65H 21/00

(52) U.S. Cl. ..... 156/159; 156/157; 156/502; 156/504; 156/507; 242/555; 242/555.4

(58) Field of Search ..... 156/157, 159, 156/502, 504, 507; 242/552, 555, 555.3, 555.4

(56) References Cited

U.S. PATENT DOCUMENTS 3,780,960 A * 12/1973 Tokuno et al. ..... 226/95
3,841,944 A 10/1974 Harris, Jr.
3,880,698 A * 4/1975 Kawazura et al. ..... 156/504
3,896,820 A * 7/1975 Ludszeweit et al. ..... 131/280
4,170,506 A * 10/1979 Marschke ..... 156/159
4,722,489 A 2/1988 Wommer
4,792,103 A * 12/1988 Schoonderbeek ..... 242/541.1
5,318,646 A * 6/1994 Cardini et al. ..... 156/157
5,975,457 A * 11/1999 Forbes ..... 242/552
6,228,205 B1 * 5/2001 Rhodes et al. ..... 156/304.3

* cited by examiner

*Primary Examiner*—Mark A. Osele
(74) *Attorney, Agent, or Firm*—Salzman & Levy

(57) ABSTRACT

A web threading and splicing system that provides easy access to the threading rolls by an operator. The new web supply roll for replacement of the expired web can be threaded at a standstill position adjacent the operator. This affords ease of access, which furnishes a great ergonomic and safety advantage, wherein the operator does not have to reach into moving web components in order to accomplish the splice.

19 Claims, 6 Drawing Sheets

WEB SPLICING SYSTEM

This application is a continuation-in-part of U.S. patent application Ser. No. 09/036,958, filed Mar. 9, 1998, now abandoned.

FIELD OF THE INVENTION

The present invention relates to web splicers and, more particularly, to a web splicing system that features an easily threadable and loadable web apparatus that provides safety, convenience, and improved ergonomics.

BACKGROUND OF THE INVENTION

Through the years, a great number of designs for web splicing machines have been proposed. Many of these designs are very complex and their reliability is poor. Machines of complexity and poor reliability are usually those featuring movable turrets and precision load and splice timing. Controllers and/or computers are usually required to provide this precise timing. These complex machines tend to be more costly and difficult to load and thread. The threading and loading difficulties also give rise to lower operating safety and poor ergonomics.

The web splicing machine of this invention is a simple apparatus that is easy to load and thread, is safer, less costly, and does not require a controller or a computer to provide splice timing. Moreover, the splicing operation is performed on the fly and minimizes tension along the web material.

The web splicer of the invention is mounted on a movable assembly that is withdrawn from the moving web to provide the operator with a facile means for threading the new web roll into the apparatus. In the past, operators would have to extend their limbs into the moving machinery, thus giving rise to a greater possibility for injury. U.S. Pat. No. 3,841,944, issued to W. W. HARRIS, JR. for WEB SPLICING APPARATUS, discloses a machine adapted to splice a web from a reserve roll to the web from an expiring supply roll. Two carriages rotate through an arc as they move toward and away from each other. Within each carriage, flat plates or holding surfaces are disposed in parallel planes. In operation, one of the plates is extended towards the other by a motor and piston rod. The web is disposed above the plate, so a tension spike is produced as the plates engage each other. In effect, the web and its splice are pulled through a vise formed by the two plates. Such a system is completely inadequate for use with thin film material, which is prone to rupture when subjected to tension.

Another drawback of the HARRIS system is the cutter, used to cut the tail of the expiring roll after the splice. Since the HARRIS apparatus is used in a commercial paper mill environment, safety is not an issue, so the cutter is exposed. Moreover, its application to the web results in a deflection thereof, prior to bursting the web material. Once again, this severing operation introduces unwanted tension along the web, which is especially unacceptable when handling thin film.

U.S. Pat. No. 4,722,489, issued to THOMAS WOMMER for DEVICE FOR FEEDING MATERIAL TAPES, also discloses a splicing apparatus. Once again, however, flat fixing bars or plates are used to push the web material from supply and expiring rolls towards each other. In WOMMER, however, the splicing operation is accomplished while the two segments of web material to be spliced are stationary with respect to each other. A magazine or accumulator is used to allow the web to continue to be extracted from the supply roll without affecting the tension of the web while the material is pressed between plates and the movement thereof is halted. The large moments of inertia of commercial web rolls makes instantaneous starting and stopping of their motion impossible, so that the WOMMER accumulator is necessary for his separate, discrete splicing step.

The movable splicing assembly of the current invention eliminates operator contact with the moving web. In addition, the movable assembly brings the threading apparatus to the operator, thus improving ergonomics.

SUMMARY OF THE INVENTION

In accordance with the present invention, there is provided a movable web splicing system for splicing a new web roll to an expiring web roll. The movable system comprises a first work station and a second work station. Each work station comprises respective first and second, movable threading assemblies. Each of the threading assemblies is movable between a web splicing/feeding position, where they are adjacent each other, and a web threading position at an extended location to each other.

Each assembly has a first and second juxtaposed threading roll and a vacuum roll, having a series of air holes disposed therein, for drawing a vacuum upon the edge of a threaded web. The vacuum roll is disposed adjacent the two juxtaposed threading rolls. The vacuum roll of the first movable threading assembly is movable between a splicing position and a non-splicing position. A crank arm connected to, and powered by, a pneumatic piston pivotally supports this vacuum roll, so that it is caused to move between its splicing and non-splicing positions. Another pneumatic piston is connected to a web clamp disposed adjacent the first positioned threading roll of each of the first and second movable assemblies. The pneumatically controlled clamps of each assembly are movable between a web clamping position adjacent each first juxtaposed threading roll, and a non-clamping position at a non-extended position with respect to said respective, first, juxtaposed threading roll. The vacuum roll of the second movable assembly is positioned in place. The pneumatic piston of this assembly operates and connects only to the web clamp disposed adjacent the first juxtaposed threading roll. A pneumatically controlled cutting knife is disposed between the vacuum roll and the second juxtaposed threading roll of each assembly, extremely close to the web itself. Moreover, an anvil having a groove or slot allows severing of the web cleanly and quickly, without deflecting the web prior to bursting.

The splicing machine operates so that a second web supply roll that is about to become exhausted is threaded upon the second assembly that is disposed at its splicing position. The second, or old, web is movably threaded around the juxtaposed threading rolls and the vacuum roll whose vacuum is inoperative in free flow. The web is freely flowable about all three rolls. The pneumatic piston controlling the clamp for the first positioned roll is nominally in its non-extended position. As the second web is about to become exhausted, the operator of the splicing system mounts a new web supply roll upon a mandrel located at the first work station. After the new supply roll is rotatively secured upon the mandrel, the operator withdraws the first assembly from its web splicing/feeding position to its web threading position located adjacent the operator. The operator then proceeds to thread the new supply web about the three rolls. The leading edge of the web is positioned about the vacuum roll. The vacuum roll is actuated to draw its vacuum through perforations in the surface of the roll and the leading edge of the new web is pressure adhered thereto.

The pneumatic piston is actuated to move the web clamp into adjacent contact with the first positioned roll, so that the interdisposed new web is held firmly to the first positioned roll. This prevents the new web from tending to slip backwardly and withdraw into the new supply roll. The new web being firmly threaded within the first assembly, the operator pushes a button that moves the first assembly into its splicing and feeding position.

When the first assembly moves into the splicing and feeding position, the pneumatic piston of the first assembly actuates, causing the crank arm to move the first vacuum roll and its respective web into contact with the old web disposed on the second vacuum roll. At the same time, the first clamp is moved to its non-extended position, thus releasing the new web for movement about the first juxtaposed threading roll.

The leading edge of the new web has an adhesive surface that adheres to the old, second web, when the two vacuum rolls come into contact. In this way, the new, first web is spliced to the old, second web. Simultaneously therewith, the second cutting blade is pneumatically actuated, thus severing the old, second web from its respective supply roll. This completes the splicing operation.

When the new, first web becomes exhausted, a new, second web supply roll is mounted upon the second work station, and the second movable assembly is withdrawn from the splicing/feeding position. After threading the new, second web into the second assembly, in similar manner to that previously described for the first assembly, the operator pushes a button at the second station to actuate the splice sequence. The crank arm of the first assembly causes the first vacuum roll to contact the second vacuum roll, thus causing contact of the old, first web, with the new, second web. The second clamp is caused to move to its non-extended position, thus freeing the second, new web for movement with respect to the first juxtaposed threading roll of the second assembly. The vacuum is then released on the second vacuum roll. The first cutting knife then cuts the first, old web, thus completing the splice, as before. An accumulator device, or "dancer", is located downstream from the first and second work stations along a web feed path, in order to maintain the proper tension in the moving web during the splice. The splicing system of this invention is configured to allow for the splice when the web is either stationary or moving. The timing of each component during the splicing sequence can be accomplished by simple electronic relay or delay mechanisms.

It is one object of the invention to provide an improved web splicing system for use on the fly.

It is an object of this invention to provide a movable splicing assembly for a web splicing system, wherein the system is easier than conventional apparatus to thread and is safer to operate.

It is another object of the invention to provide an ergonomic web splicing assembly wherein the operator can move the splicing assembly to provide easy access for threading the web thereupon.

It is a further object of this invention to provide a less complicated web splicing system that is more reliable than conventional apparatus and less costly to construct.

It is yet another object of the invention to provide a cutting mechanism that is both safe and non-disruptive to the flow of the web material.

It is still a further object of the invention to provide a splicing device for web material that can be operated on the fly with thin film, since the web is not appreciably deflected from its path during the splice.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same numbering and designations throughout the figures.

DESCRIPTION OF THE PREFERRED EMBODIMENT

Generally speaking, the invention features a web threading and splicing system that provides easy access to the threading rolls by an operator. The new web supply roll for replacement of the expended web can be threaded at a standstill position adjacent the operator. This affords ease of access, which furnishes a great ergonomic and safety advantage, wherein the operator does not have to reach into moving web components in order to accomplish the splice.

Figure 1:
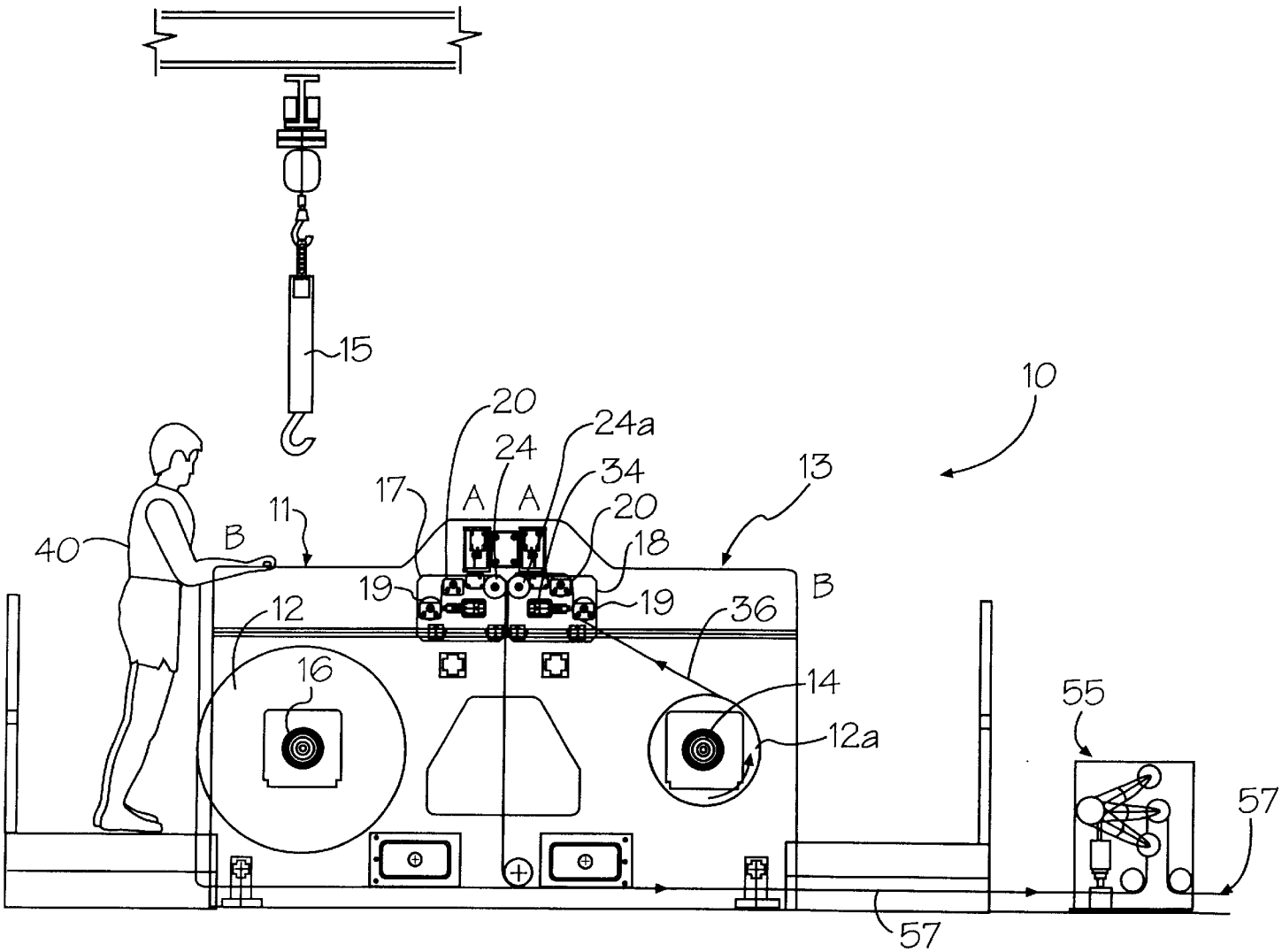
FIG. 1 illustrates a side view of the web splicing system of this invention, having movable web splicing assemblies shown in their respective web splicing positions.
Figure 2:
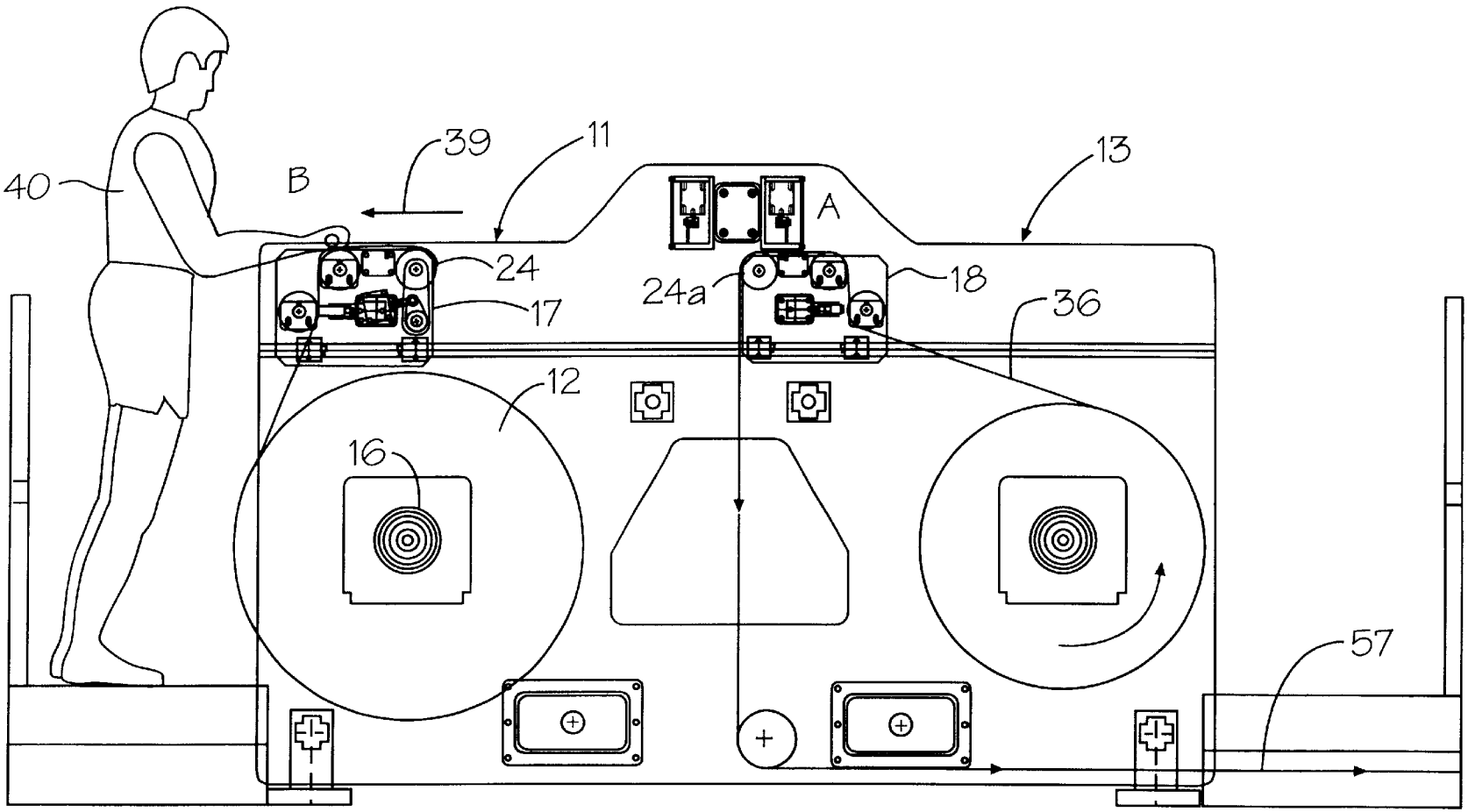
FIG. 2 depicts a slightly enlarged side view of the web splicing system shown in FIG. 1, with one of the movable splicing assemblies in its threading position adjacent an operator.

Now referring to FIG. 1, the web splicing system 10 of this invention is shown. The splicing system 10 has two work stations 11 and 13, respectively. The web splicing system 10 is shown prior to splicing a new or replacement web supply roll 12 to an expiring web supply roll 14 rotatively mounted on mandrel 14 at work station 13. The new supply roll 12 has been delivered to the work station 11 by a crane 15 and has been mounted on rotatable mandrel 16, as shown. Each work station 11 and 13, respectively, comprises respective movable threading assemblies 17 and 18. Each of the threading assemblies 17 and 18, respectively, is movable between a web splicing/feeding position "A", where the assemblies 17 and 18 are adjacent each other, as shown in FIG. 1, and a web threading position "B", at an extended location at the end of their respective work stations 11 and 13, as better observed in FIGS. 2 and 3.

Figure 3:
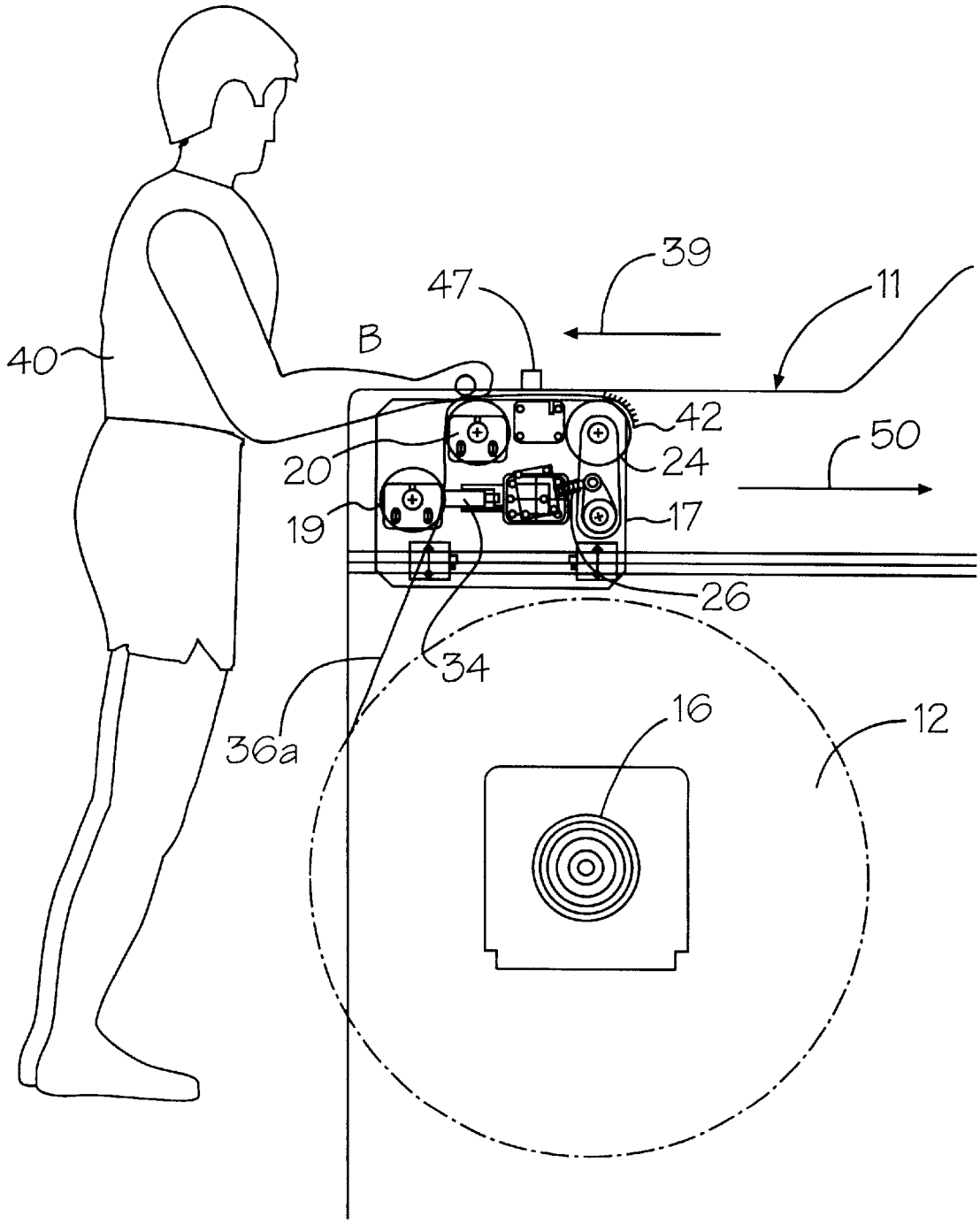
FIG. 3 shows a greatly enlarged side view of the movable assembly depicted in FIG. 2, as it is being threaded by the operator of the web splicing system.
Figure 4:
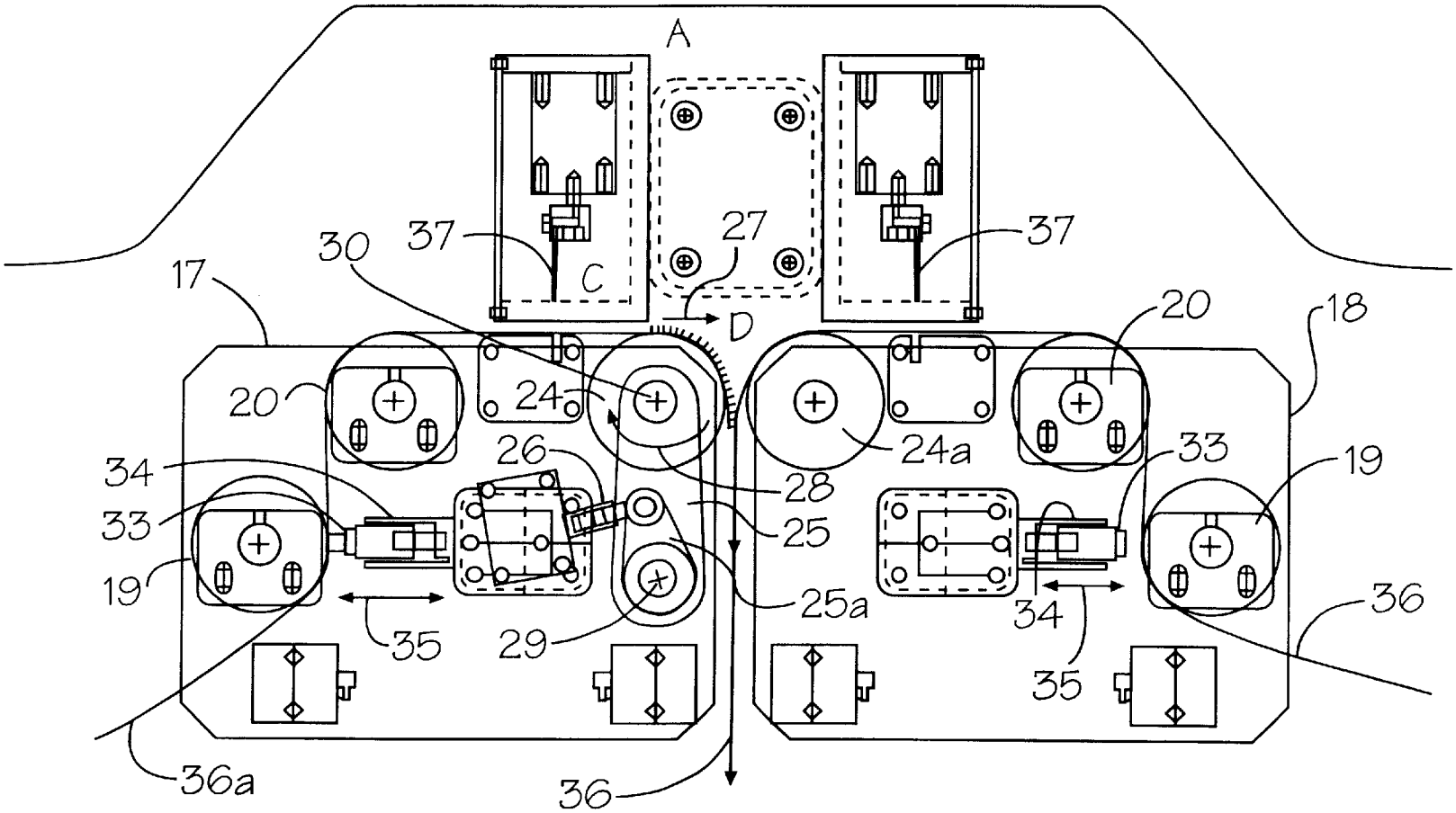
FIG. 4 illustrates an enlarged view of the web splicing assemblies shown in FIG. 1, disposed at their splicing and feeding positions, with a new replacement web depicted as having been threaded on the right assembly.

Each assembly 17 and 18 has two juxtaposed threading rolls 19 and 20, better seen with reference to FIGS. 3 and 4. The juxtaposed threading rolls 19 and 20 allow the web to be snaked between them, thus creating web tension therebetween. The juxtaposed threading rolls 19 and 20 are rotatably fixed to their respective movable assemblies 17 and 18. Respective vacuum rolls 24 and 24*a* having a series of air holes disposed therein (FIG. 5) for drawing a vacuum upon the leading edge of a replacement web, is rotatively secured to each respective assembly 17 and 18. Each vacuum roll 24 and 24*a* is respectively disposed adjacent the two juxtaposed threading rolls 19 and 20.

The vacuum roll 24 of the movable threading assembly 17 is pivotally operative (arrow 27) between a splicing position "D" and a non-splicing position "C", as depicted in FIG. 4, by virtue of being pivotally mounted upon crank arm 25, connected to, and powered by, a pneumatic piston 26 that moves inferior crank 25*a*. The inferior crank arm 25*a* is pivotally secured to larger crank arm 25 about pivot point 29. They both pivot under the influence of pneumatic piston 26. The bigger crank arm 25 supports the vacuum roll 24 for pivotable movement (arrow 27) about pivot point 29, and rotation (arrow 28) about the support shaft 30 to which it is rotatively secured. The vacuum roll 24 pivots between its respective splicing and non-splicing positions "D" and "C", as will be further explained hereinafter.

Figure 5:
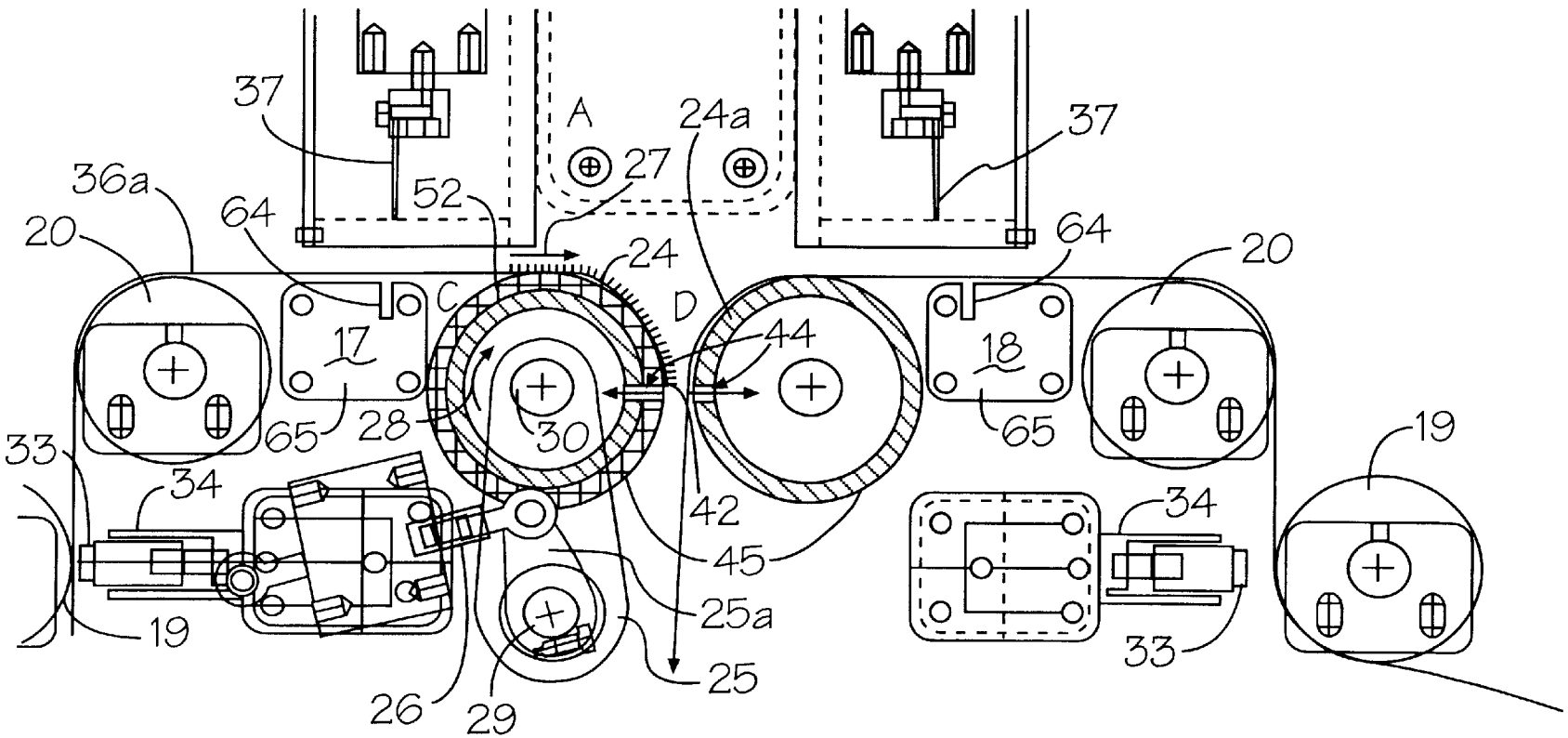
FIG. 5 shows a greatly enlarged view of the web splicing assemblies depicted in FIG. 4, which enlarged view provides greater structural details of the feed and threading rolls.

A pneumatic piston 34 is also connected to a web clamp 33 disposed adjacent the first juxtaposed threading roll 19 of each of the respective movable assemblies 17 and 18. The pneumatically controlled clamps of each assembly are movable between a web clamping position adjacent each first juxtaposed roll 19, and a non-clamping position at a non-extended position with respect to said respective first juxtaposed roll 19, as illustrated by arrows 35. The vacuum roll 24 of the second movable assembly 18 is positioned in place, and the pneumatic piston of this assembly operates and connects only to the web clamp 34 disposed adjacent the first juxtaposed threading roll 19. A pneumatically controlled cutting knife 37 is disposed between the vacuum roll 24 and second juxtaposed threading roll 20 of each assembly 17 and 18, as shown in FIGS. 4 and 5. Cutting knife 37 is disposed very close to the path of the web, eliminating danger to an operator who cannot squeeze his hand or fingers into the cutting mechanism.

Operation Of The Splicing System

The splicing system 10 operates so that a second web supply roll 12*a* (FIG. 1) that is about to become exhausted is threaded through the second assembly 18 disposed at its splicing position "A". The old web 36 is movably threaded around the juxtaposed threading rolls 19 and 20, respectively, and the vacuum roll 24, the vacuum of which is inoperative in free flow. The web is freely flowable about all three threading rolls 19, 20, and 24, respectively. The pneumatic piston 34 controlling the clamp for the first juxtaposed threading roll 19 is normally in its non-extended position.

As the second web 36 is about to become exhausted, the operator 40 of the splicing system 10 mounts a new web supply roll 12 upon the mandrel 16 located at the first work station 11. After the new supply roll is rotatively secured upon the mandrel 16, the operator 40 withdraws (arrow 39, FIGS. 2 and 3) the first assembly 17 from its web splicing/feeding position "A", to its web threading position "B" located adjacent the operator 40. The operator 40 then proceeds to thread the new supply web about the three threading rolls 19, 20, and 24, respectively, so that the leading edge 42 of the new, replacement web 36*a* (FIG. 3) is positioned about the vacuum roll 24, as illustrated. The vacuum roll 24 is actuated to draw its vacuum through perforations 44 in the surface 45 of the vacuum roll 24, as shown in FIG. 5.

Referring again to FIG. 3, the leading edge 42 of the web 36*a* is pressure adhered to the vacuum roll 24. The pneumatic piston 34 is actuated to move the web clamp 33 into adjacent contact with the first juxtaposed threading roll 19. The interdisposed new web 36*a* is now held firmly to the first juxtaposed threading roll 19. This prevents the new web 36*a* from tending to slip backwardly and withdraw into the new supply roll 12.

The new web 36*a* being firmly threaded within the first assembly 17, the operator 40 pushes a button 47 disposed on top of a control panel (not shown) that moves (arrow 50) the first assembly 17 into its splicing and feeding position "A". When the first assembly 17 moves (arrow 50) into the splicing and feeding position "A", as illustrated in FIG. 4, the pneumatic piston 26 of the assembly 17 actuates and causes the crank arms 25*a* and 25, respectively, to move the vacuum roll 24*a* and its respective web 36*a* into contact with the old web 36 disposed on the second vacuum roll 24. At the same time, the first clamp 33 is moved to its non-extended position, thus releasing the new web 36*a* for movement about the first juxtaposed threading roll 19. The leading edge 42 of the new web 36*a* has an adhesive surface 54 that adheres to the old, second web 36 when the two vacuum rolls 24 and 24*a* come into contact at point "D", causing the new web 36*a* to be spliced to the old web 36. As can be seen, the webs 36 and 36*a* are not deflected from their paths, since vacuum rolls 24 and 24*a* are close together, so tension along the webs is minimized during the splicing operation.

Simultaneously therewith, the second cutting blade 37 is pneumatically actuated, thus severing the old web 36 from its respective supply roll 12*a* and completing the splicing operation. When the new web 36*a* becomes exhausted, a new, second web supply roll 12*a* is mounted upon the second work station 13, and the second movable assembly 18 is withdrawn from the splicing and feeding position "A".

After threading the new, second web onto the second assembly 18, in a manner similar to that previously described for the first assembly 17, the operator 40 pushes a button 47 at the second work station 13 to actuate the splice sequence once again. The crank arm 25 of the first assembly 17 causes the first vacuum roll 24 to contact the second vacuum roll 24*a*, thus causing contact of the old, first web, with the new, second web. The second clamp 33 moves to its non-extended position, thus freeing the second, new web 36*a* for movement with respect to the first juxtaposed roll 19 of the second assembly 18. The vacuum is then released on the second vacuum roll 24*a*. The first cutting knife 37 then cuts the first, old web 36*a*, thus completing the splice, as before.

An accumulator device, or "dancer" 55 (FIG. 1) is located downstream from the first and second work stations, 11 and 13, respectively, along the web feed path 57, in order to maintain the proper tension in the moving web during the splice. The splicing system of this invention is configured to allow for the splice when the web is either stationary or moving. The timing of each component during the splicing sequence can be accomplished by simple electronic relay or delay mechanisms.

Referring again to FIG. 5, the vacuum roll 24 of movable assembly 17 comprises an outer elastomeric cover 52 for providing a shock resilient surface. The elastomeric material of cover 52 can be rubber, neoprene, etc. The shock resilient surface can be part of vacuum roll 24*a*, instead of vacuum roll 24. However, one shock resilient surface is required between the two vacuum rolls 24 and 24*a* in order to provide a quiet contact when vacuum roll 24 moves (arrow 27) from position "C" to contract position "D".

The end section of the replacement web is covered with an adhesive strip from the leading edge 42 of the web 36*a* to the area below the cutting knife apparatus 37. A protective tear-off strip exposes the sticky adhesive, so that when the two vacuum rolls 24 and 24*a* come into contact, the two respective webs 36*a* and 36 bond together, thus completing the splice. Cutting knife 37 cooperates with a groove or slot 64 in an anvil 65, to effect a clean, quick severing of the web 36*a* without introducing a tension spike therealong. The anvil 65 and groove 64 arrangement allows the web 36*a* to be cut without being deflected appreciably prior to bursting, as is common in prior art devices.

Figure 6:
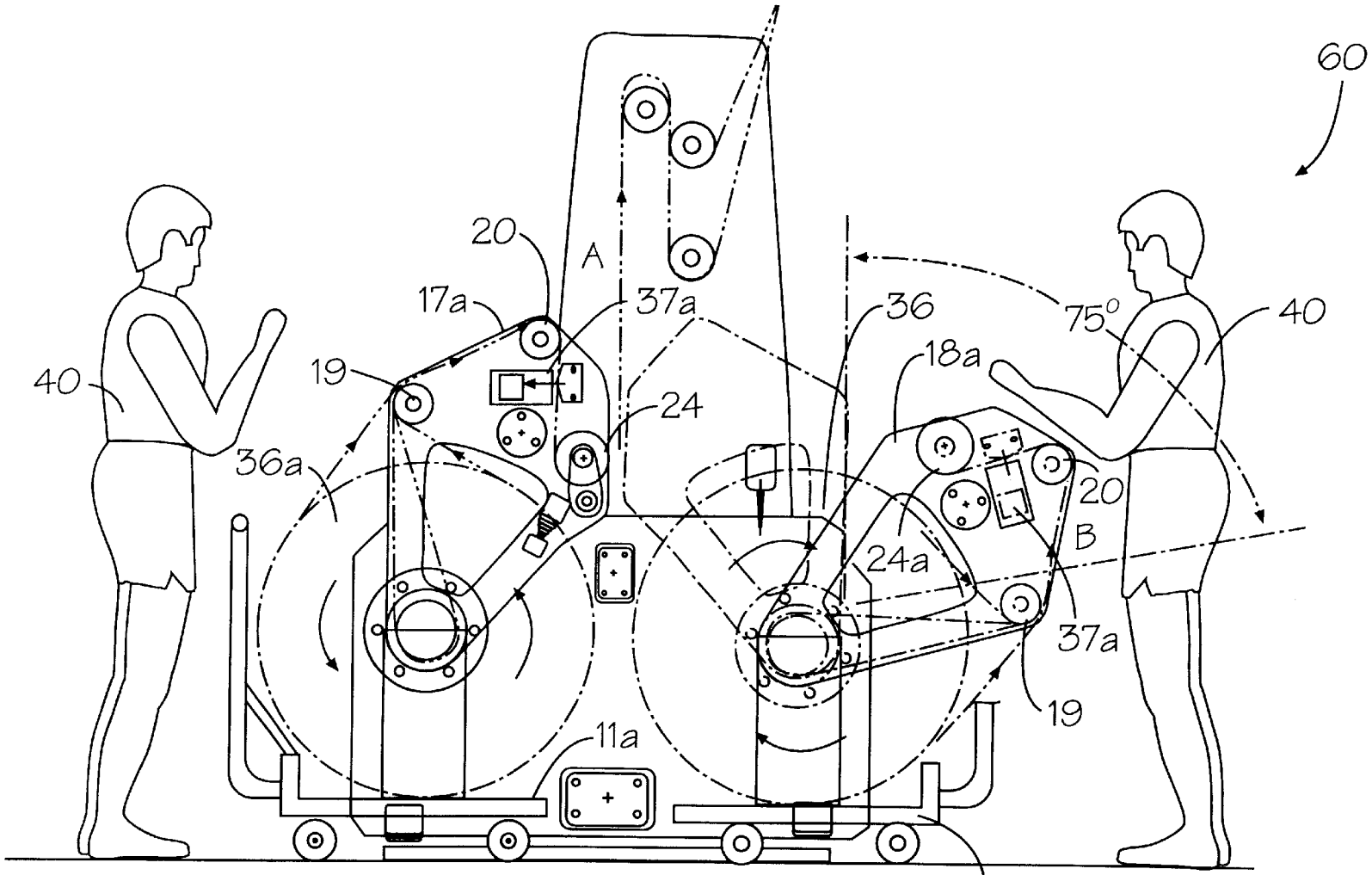
FIG. 6 depicts a side view of an alternate embodiment of the movable assembly configuration for the web splicing system illustrated in FIG. 1.

Referring to FIG. 6, an alternate embodiment 60 is illustrated for the movable assemblies 17 and 18, respectively, and for the work stations 11 and 13, respectively, shown in FIGS. 1 through 5. The work stations 11 and 13 are now shown as portable roll carts 11*a* and 13*a*, respectively, and the movable assemblies 17 and 18 are now shown as pivotable assemblies 17*a* and 18*a* that are pivotally secured to the roll carts 11*a* and 13*a*, respectively. The roll carts 11*a* and 13*a* allow for loading web supply rolls 36*a* and 36, respectively. The movable assemblies 17*a* and 18*a* pivot about the web supply rolls 36 and 36*a*, as illustrated. These pivotable assemblies 17*a* and 18*a* function identically with the slidable assemblies 17 and 18, shown in FIGS. 1 through 5. They pivot into position "A" from position "B", rather than slide from position "A" to position "B". The only structural difference between the assemblies of this embodiment and that shown in FIGS. 1 through 5, is that the knife blade apparatus 37*a* is now mounted on the pivotal assemblies 17*a* and 18*a*, respectively, rather than affixed above the respective movable assemblies 17 and 18. As before, the knife blade apparatus (37, 37*a*) is disposed between the vacuum rolls 24 and 24*a* and their adjacent second threading rolls 20.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A web splicing system having operator movable threading assemblies, comprising: a first work station supporting a first web supply roll and a first operator movable threading assembly, and a second work station supporting a second web supply roll and a second operator movable threading assembly, said first and second operator movable threading assemblies each being manually movable between a web splicing/feeding position, where they are adjacent each other, and a web threading position at an extended location accessible to an operator, each movable threading assembly having a threading roll and web securing means for securing said web with respect to said threading roll and its respective first and second supply roll, said two threading rolls being pressed against each other during the splicing operation, and means carried upon said first and second work stations for splicing first and second webs of said respective first and second web supply rolls when both said movable assemblies are in the splicing/feeding positions.

2. The web splicing system in accordance with claim 1, wherein said first and second movable assemblies are slidably movable between said web splicing/feeding position and said web threading position.

3. The web splicing system in accordance with claim 1, wherein said first and second movable assemblies are pivotally movable between said web splicing/feeding position and said web threading position.

4. The web splicing system in accordance with claim 1, wherein at least one of said threading rolls of said first and second movable assemblies comprises a vacuum roll having perforations for securing a leading edge of a respective web.

5. The web splicing system in accordance with claim 4, wherein said vacuum roll of said first movable assembly is movable between a splicing position and a non-splicing position by means of a crank arm connected to said vacuum roll and connected to, and powered by, a pneumatic piston supported upon said first work station.

6. The web splicing system in accordance with claim 1, wherein each threading means comprises a plurality of threading rolls, and said web securing means comprises a pneumatically operated clamp for clamping a respective web to a threading roll of said threading means.

7. The web splicing system in accordance with claim 5, wherein said vacuum roll of said first movable threading assembly is pivotally attached to said first movable threading assembly and is pivoted between said splicing position and said non-splicing position.

8. The web splicing system in accordance with claim 1, wherein said web securing means for securing its respective web with respect to said threading means and its respective supply roll comprises a pneumatically controlled clamp affixed to its respective work station.

9. The web splicing system in accordance with claim 1, further comprising web severing means proximate said web for cutting a portion thereof on the fly.

10. The web splicing system in accordance with claim 9, wherein said web severing means comprises a cutting knife and an anvil cooperating therewith, said anvil having a groove disposed therein for receiving said cutting knife during said cutting operation.

11. A web splicing system having operator movable threading assemblies, comprising:

means defining a web feed path;

a first work station disposed along said web feed path, said first work station supporting a first web supply roll and a first operator movable threading assembly;

a second work station disposed along said web feed path, said second work station supporting a second web supply roll and a second operator movable threading assembly, said first and second operator movable threading assemblies each being manually movable between a web splicing/feeding position, where they are adjacent each other, and a web threading position at an extended location accessible to an operator, each operator movable threading assembly having a web threading roll;

splicing means carried upon said first and second work stations for splicing first and second webs of said respective first and second web supply rolls when both said operator movable threading assemblies are in their respective splicing and feeding positions; and web severing means proximate said web feed path for cutting a portion of said web after said splicing is performed.

12. The web splicing system in accordance with claim 11, wherein said first and second movable assemblies are slidably movable between said web splicing/feeding position and said web threading position.

13. The web splicing system in accordance with claim 11, wherein said first and second movable assemblies are pivotally movable between said web splicing/feeding position and said web threading position.

14. The web splicing system in accordance with claim 11, wherein each threading assembly comprises a plurality of threading rolls and web securing means comprising a pneumatically operated clamp for clamping a respective web to a threading roll of said threading assembly.

15. The web splicing system in accordance with claim 11, wherein said web severing means comprises a cutting knife and an anvil cooperating therewith, said anvil having a groove disposed therein for receiving said cutting knife during said cutting operation.

16. A method of splicing an expiring web to a replacement web using manually positioned splicing units, comprising the steps of:

a) moving a web threading roll from a web splicing position to an operator threading position;

b) threading said web threading roll with a replacement web;

c) moving said threading roll to said web splicing position; and d) splicing said replacement web to the expiring web on the fly using a manually positioned splicing unit.

17. The method of splicing an exhausting web to a replacement web in accordance with claim 16, wherein the web threading means of step (a) includes sliding said web threading means upon a work station.

18. The method of splicing an exhausting web to a replacement web in accordance with claim 16, wherein moving the web threading means of step (a) includes pivoting said web threading means upon a work station.

19. The method of splicing an exhausting web to a replacement web in accordance with claim 16, the steps further comprising:

e) severing a portion of said replacement web.

* * * * *